US010363594B2

(12) United States Patent
Kohno et al.

(10) Patent No.: US 10,363,594 B2
(45) Date of Patent: Jul. 30, 2019

(54) DIE CUSHION APPARATUS OF PRESS MACHINE AND DIE CUSHION CONTROLLING METHOD

(71) Applicant: AIDA ENGINEERING, LTD., Sagamihara-shi, Kanagawa (JP)

(72) Inventors: Yasuyuki Kohno, Sagamihara (JP); Tadahiro Kondo, Sagamihara (JP); Ryosho Iwamura, Sagamihara (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 473 days.

(21) Appl. No.: 15/368,315

(22) Filed: Dec. 2, 2016

(65) Prior Publication Data

US 2017/0080472 A1 Mar. 23, 2017

Related U.S. Application Data

(62) Division of application No. 14/162,377, filed on Jan. 23, 2014, now Pat. No. 9,808,848.

(30) Foreign Application Priority Data

Jan. 24, 2013 (JP) ..... 2013-011043

(51) Int. Cl.
*B21D 24/02* (2006.01)
*B21D 24/14* (2006.01)
(Continued)

(52) U.S. Cl.
CPC ..... *B21D 24/02* (2013.01); *B21D 22/22* (2013.01); *B21D 24/08* (2013.01); *B21D 24/14* (2013.01); *B30B 15/24* (2013.01)

(58) Field of Classification Search
CPC ..... B21D 22/10; B21D 22/22; B21D 24/02; B21D 24/04; B21D 24/06; B21D 24/08;
(Continued)

(56) References Cited

U.S. PATENT DOCUMENTS 5,138,857 A 8/1992 Siegert
5,419,169 A 5/1995 Kirii
(Continued)

FOREIGN PATENT DOCUMENTS

DE 3744177 A1 7/1989
DE 4125121 A1 2/1993
(Continued)

OTHER PUBLICATIONS

U.S. Office Action issued in U.S. Appl. No. 14/162,377 dated Feb. 16, 2017.
European Search Report EP 14 15 2108 dated Apr. 4, 2014.

*Primary Examiner* — Peter Dungba Vo
*Assistant Examiner* — Joshua D Anderson
(74) *Attorney, Agent, or Firm* — McDermott Will & Emery LLP

(57) ABSTRACT

According to the die cushion apparatus of a press machine and the die cushion controlling method of the present invention, in holding the cushion pad on standby at a desired standby position, it is possible to hold the cushion pad on standby in parallel with the lower faces of the dies mounted to the slide, and if the lower faces of the dies are inclined, it is possible to hold the cushion pad on standby in the state of being inclined. Through this configuration, it is possible to easily allow the material to come into contact with the lower faces of the dies from the beginning of the die cushion force control (beginning of the collision), and also possible to smoothen the die cushion action in the plane, thereby enhancing the formability.

4 Claims, 11 Drawing Sheets

(51) Int. Cl.

| | |
|---|---|
| ***B30B 15/24*** | (2006.01) |
| ***B21D 24/08*** | (2006.01) |
| ***B21D 22/22*** | (2006.01) |

(58) Field of Classification Search

CPC ..... B21D 24/10; B21D 24/12; B21D 24/14; B30B 15/007; B30B 15/061; B30B 15/16; B30B 15/166; B30B 15/24

See application file for complete search history.

(56) References Cited

U.S. PATENT DOCUMENTS

| | | | |
|---|---|---|---|
| 5,687,598 | A | 11/1997 | Kirii et al. |
| 7,918,120 | B2 | 4/2011 | Suzuki |
| 8,468,866 | B2 | 6/2013 | Miyasaka et al. |
| 2002/0184935 | A1 | 12/2002 | Naumann et al. |

FOREIGN PATENT DOCUMENTS

| | | | |
|---|---|---|---|
| DE | 102007033943 | A1 | 1/2009 |
| EP | 0 453 955 | A1 | 10/1991 |
| EP | 0692323 | A2 | 1/1996 |
| JP | 2007-136500 | A | 6/2007 |

DIE CUSHION APPARATUS OF PRESS MACHINE AND DIE CUSHION CONTROLLING METHOD

RELATED APPLICATIONS

This application is a Division of application Ser. No. 14/162,377, filed on Jan. 23, 2014, which in turn claims the benefit of Japanese Patent Application No. 2013-011043, filed on Jan. 24, 2013, the disclosures of which applications are incorporated by reference herein.

BACKGROUND OF THE INVENTION

Field of the Invention

The present invention relates to a die cushion apparatus of a press machine and a die cushion controlling method, particularly, to a technique of raising and lowering a cushion pad using separately-controllable multiple driving shafts.

Description of the Related Art

A general die cushion apparatus of a press machine performs a die cushion force control on a cushion pad during a stroke from a die cushion standby position to a press bottom dead center while a lower die (blank holder) and an upper die (dies) mounted to a slide of the press machine via a material are in tightly contact with each other.

As shown in FIG. 10A, in a state where a cushion pad 2 is held at the standby position, a plane face of the cushion pad 2 (blank holding plate 206 supported via cushion pins 1) is disposed in parallel with a slide 104 (plane face to which an upper die 202 is mounted) of the press machine. Note that it is obvious for those skilled in the art who are manufacturers and users of such an apparatus to set and adjust the cushion pad 2 to be held at the standby position in parallel with the slide 104.

In the above die cushion force control, the cushion pad often becomes inclined in accordance with the slide (plane face to which the dies are mounted) having greater rigid via the die and the material because a dimension of each die (die+material thickness+blank holder+cushion pin length) becomes different, which results from the degree of shim adjustment on various portions of the die, and local variation in plate thickness of the material (particularly, significant variation in plate thickness of a tailor welded blank material), or in the case of forming the material using two or more types of dies between a single slide of the press machine and a single cushion pad.

If the die cushion force is controlled as shown in FIG. 10B, the cushion pad 2 becomes inclined in accordance with inclination of the lower faces of the dies (left and right upper dies 202) mounted to the slide 104.

FIG. 11 is a graph showing a time course of a die cushion forces L, R generated on the left and right driving shafts that chiefly support the cushion pad 2 during the die cushion force control. As shown in this drawing, at the start of the die cushion force control, the right die having a longer length initially collides, and the right die cushion force R starts up at the time $t_1$. The left die collides following the right die, so that the left die cushion force L starts up at the time $t_2$ behind with the time $t_1$.

As a conventional die cushion apparatus for controlling the cushion pad through multiple driving shafts, a die cushion apparatus described in Japanese Patent Application Laid-Open No. 2007-136500 has been known.

The die cushion apparatus described in Japanese Patent Application Laid-Open No. 2007-136500 includes multiple die cushion mechanisms (screw nut mechanisms) having driving shafts respectively connected to a cushion pad, multiple servo motors for respectively driving the multiple die cushion mechanisms, and a control unit for controlling multiple servo motors, wherein the control unit controls currents supplied to each servo motor based on the load generated on a cushion pad, thereby controlling the die cushion force. A position in the vertical direction of the cushion pad is measured by a linear scale mechanism, and information regarding the measured position of the cushion pad is outputted to the control unit.

SUMMARY OF THE INVENTION

As shown in FIG. 10A, if the cushion pad 2 shifts from a standby state at the die cushion standby position to a state where the die cushion force control is performed as shown in FIG. 10B, the cushion pad 2 becomes inclined in accordance with the inclination of the lower faces of the upper dies 202 mounted to the slide 104, and this inclination becomes drastic at the moment of the start of the die cushion force control (at the moment of collision between the upper dies and the lower dies), in particular. As shown in FIG. 11, at the start of the die cushion force control (at the moment of the collision), a great difference is generated between the left and right die cushion forces L and R of the cushion pad 2, and this hinders stability of the die cushion force control, which causes unbalance between the left and right. Such a difference in die cushion force between the left and the right causes rupture of the material, or causes bad influences on formability (particularly, formability on the left side following the right side), resulting in variation in force in the plane face.

Meanwhile, measurement of the position of the cushion pad with the linear scale mechanism is described in Japanese Patent Application Laid-Open No. 2007-136500, but there is no description regarding positional control for controlling the standby position of the cushion pad and others. This linear scale mechanism is disposed on only one side of the cushion pad, and thus it is impossible to adjust inclination of the cushion pad or the like by separately controlling the multiple die cushion mechanisms.

An object of the present invention, which has been made in order to solve the problems according to the conventional art, is to provide a die cushion apparatus of a press machine and a die cushion controlling method capable of suppressing drastic inclination of the cushion pad that is generated at the start of the die cushion force control, as well as smoothening the die cushion action in the plane face, thereby enhancing formability.

In order to attain the aforementioned object, a die cushion apparatus of a press machine according to a first aspect of the present invention includes: an information acquiring device which acquires information regarding inclination of a cushion pad in a duration of die cushion force control, wherein the cushion pad is held on standby in parallel with lower faces of dies mounted to a slide of the press machine, by carrying out an adjustment, based on the information acquired from the information acquiring device.

The first aspect of the present invention includes: an information acquiring device which acquires information regarding inclination of a cushion pad in a duration of die cushion force control, and the cushion pad is held on standby in parallel with lower faces of dies mounted to a slide of the press machine, by carrying out an adjustment, based on the information acquired from the information acquiring device. Hence, it is possible to carry out an adjustment in accordance with the acquired information regarding the inclination of the cushion pad, thereby holding the cushion pad on standby in parallel with the lower faces of the dies mounted to the slide of the press machine. Specifically, if the lower faces of the dies are inclined, the cushion pad can be inclinedly held on standby, particularly, it is possible to easily allow the material to come into contact with the lower faces of the dies at the start of the die cushion force control (from the beginning of collision), as well as to smoothen the die cushion action in the plane face, thereby enhancing the formability.

According to a second aspect of the present invention, it is preferable that the die cushion apparatus of a press machine according to the first aspect further includes: multiple cushion pad raising and lowering devices which raise and lower the cushion pad by separately-controllable multiple driving shafts; a die cushion position instructing unit which respectively outputs multiple position instruction values each of which instructs a position in a raising and lowering direction of the cushion pad corresponding to a position of each driving shaft of the multiple cushion pad raising and lowering devices, the die cushion position instructing unit including multiple standby position instruction values for at least holding the cushion pad at a standby position, and outputting the multiple standby position instruction values after knocking out a product; multiple die cushion position detecting devices which detect the position in the raising and lowering direction of the cushion pad corresponding to the position for each driving shaft of the multiple cushion pad raising and lowering devices, and separately output position detected values indicating the detected positions; and a controlling device which separately controls the multiple cushion pad raising and lowering devices based on the multiple position instruction values outputted from the die cushion position instructing unit, and on the multiple position detected values outputted from the multiple die cushion position detecting devices, and moves the cushion pad to the standby position based on the multiple standby position instruction values outputted from the die cushion position instructing unit after knocking out the product, wherein the multiple standby position instruction values are adjusted based on the information acquired from the information acquiring device to allow the cushion pad to be held on standby in parallel the with lower faces of dies mounted to the slide of the press machine.

The second aspect of the present invention includes, in addition to the elements of the first aspect: the die cushion position instructing unit that respectively outputs to the multiple cushion pad raising and lowering devices the standby position instruction values which are position instruction values instructing the positions of the respective driving shafts of the multiple cushion pad raising and lowering devices, and which are used for holding the cushion pad at a desired standby position; and the information acquiring device that acquires information regarding the inclination of the cushion pad in the duration of the die cushion force control. Hence, it is possible to adjust the standby position instruction values set in multiple die cushion position instructing units in accordance with the acquired information regarding the inclination of the cushion pad, thereby holding the cushion pad on standby in parallel with the lower faces of the dies mounted to the slide of the press machine. Specifically, if the lower faces of the dies are inclined, the cushion pad can be inclinedly held on standby, particularly, it is possible to easily allow the material to come into contact with the lower faces of the dies at the start of the die cushion force control (from the beginning of collision), as well as to smoothen the die cushion action in the plane face, thereby enhancing the formability.

According to a third aspect of the present invention, it is preferable that the apparatus of the second aspect further includes a correcting device which, based on the information acquired from the information acquiring device, automatically corrects the multiple standby instruction values set in the die cushion position instructing unit so as to hold inclination of the cushion pad at the standby position of the cushion pad. Through this configuration, it is possible to automatically correct the multiple standby position instruction values set in the die cushion position instructing unit, thereby holding the cushion pad on standby in parallel with the lower faces of the dies mounted to the slide of the press machine.

A die cushion apparatus of a press machine according to a fourth aspect of the present invention includes: multiple cushion pad raising and lowering devices; a die cushion position instructing unit; multiple die cushion position detecting devices; an information acquiring device; an offset adjusting device; and a controlling device, wherein the multiple cushion pad raising and lowering devices raise and lower a cushion pad by separately-controllable multiple driving shafts; the die cushion position instructing unit outputs position instruction values for instructing positions in a raising and lowering direction of the cushion pad, and the die cushion position instructing unit includes standby position instruction values for at least holding the cushion pad at a standby position, and outputs the standby position instruction values after knocking out a product; the multiple die cushion position detecting devices detect the position of the cushion pad corresponding to the position for each driving shaft of the multiple cushion pad raising and lowering devices, and output position detected values indicating the detected positions; the information acquiring device acquires information regarding inclination of the cushion pad in a duration of die cushion force control; the offset adjusting device offsets one or more of the multiple position detected values outputted from the multiple die cushion position detecting devices by a previously-set offset value, and outputs this value; and the controlling device separately controls the multiple cushion pad raising and lowering devices based on the position instruction values outputted from the die cushion position instructing unit, and on the multiple position detected values outputted from the multiple die cushion position detecting devices, and the controlling device moves the cushion pad to the standby position based on the standby position instruction values outputted from the die cushion position instructing unit after knocking out the product, wherein the offset value is adjusted based on the information acquired from the information acquiring device to allow the cushion pad to be held on standby in parallel with the lower faces of dies mounted to the slide of the press machine.

In the second aspect of the present invention, it is configured to adjust the standby position instruction values set in the die cushion position instructing unit, but the fourth aspect of the present invention includes the offset adjusting device that appropriately offsets the multiple position detected values outputted from the multiple die cushion position detecting devices, and adjusts the offset value set in the offset adjusting device, instead of adjusting the standby position instruction values, thereby holding the cushion pad at the standby position in a desired inclination state.

According to a fifth aspect of the present invention, it is preferable that the apparatus of the fourth aspect further includes a correcting device which, based on the information acquired from the information acquiring device, automatically corrects the offset value set in the offset adjusting device so as to hold inclination of the cushion pad at the standby position of the cushion pad. Through this configuration, it is possible to automatically correct the offset value set in the offset adjusting device, thereby holding the cushion pad on standby in parallel with the lower faces of the dies mounted to the slide of the press machine.

According to a sixth aspect of the present invention, in the apparatus of any one of the first to the fifth aspect, it is preferable that the information acquiring device acquires the multiple position detected values outputted from the multiple die cushion position detecting devices as information regarding the inclination of the cushion pad, wherein the multiple position detected values are associated with each time in the duration of the die cushion force control, a position of the slide, or die cushion force applied onto the multiple driving shafts.

In a cushion pad in the duration of the die cushion force control, the position of this cushion pad and others follow the lower faces of the dies mounted to the slide, and thus the multiple position detected values at a certain time or at the position of the slide in the duration of the die cushion force control, which are outputted from the multiple die cushion position detecting devices, can be used as the information regarding the inclination of the cushion pad. If the lower faces of the dies mounted to the slide is not parallel with the cushion pad at the standby position, the die cushion forces applied to the multiple driving shafts start up at different times at the start of the die cushion force control. If it is possible to acquire the position detected value for each driving shaft at the time of startup of the die cushion force from the multiple die cushion position detecting devices, each of the acquired position detected values can be used as the information regarding the inclination of the cushion pad.

According to a seventh aspect of the present invention, in the apparatus of any one of the first to the sixth aspect, it is preferable that the multiple cushion pad raising and lowering devices function as cushion force generating devices that generate die cushion force via the multiple driving shafts at the time of lowering the slide of the press machine. Specifically, in a die cushion position control state, the multiple cushion pad raising and lowering devices can drive the multiple driving shafts so as to raise or lower the die cushion, or to hold the die cushion at the standby position, and if the state is changed over to a die cushion force control state, the multiple cushion pad raising and lowering devices can generate the die cushion force.

The invention according to an eighth aspect of the present invention is a die cushion controlling method in the die cushion apparatus of a press machine according to the first aspect, and the die cushion controlling method includes: a step of driving the slide of the press machine so as to carry out a test press; a step of acquiring information regarding the inclination of the cushion pad in the duration of the die cushion force control during the test press; and a step of carrying out an adjustment, based on the acquired information, to hold the inclination of the cushion pad at the standby position of the cushion pad.

According to the eighth aspect of the present invention, it is configured to acquire the information regarding the inclination of the cushion pad in the duration of the test press, and to adjust the inclination based on the acquired information regarding the inclination of the cushion pad. Through this configuration, it is possible to hold the cushion pad on standby at the standby position in parallel with the lower faces of the dies mounted to the slide of the press machine, and if the lower faces of the dies are inclined, it is possible to hold the cushion pad on standby in the state of being inclined.

The invention according to a ninth aspect of the present invention is a die cushion controlling method according to the eighth aspect, and the die cushion controlling method further includes: a step of outputting the multiple standby position instruction values that are set from the die cushion position instructing unit before a test press so as to hold the cushion pad at the standby position, wherein the step of carrying out an adjustment is a step of adjusting, based on the acquired information, the multiple standby position instruction values set in the die cushion position instructing unit so as to hold the inclination of the cushion pad at the standby position of the cushion pad.

According to the ninth aspect of the present invention, it is configured to acquire the information regarding the inclination of the cushion pad in the duration of the test press, and to adjust the multiple standby position instruction values set in the die cushion position instructing unit based on the acquired information regarding the inclination of the cushion pad. Through this configuration, it is possible to hold the cushion pad on standby at the standby position in parallel with the lower faces of the dies mounted to the slide of the press machine, and if the lower faces of the dies are inclined, it is possible to hold the cushion pad on standby in the state of being inclined.

According to a tenth aspect of the present invention, in the die cushion controlling method according to the ninth aspect, the step of adjusting the standby instruction values may be manually or automatically carried out.

The invention according to an eleventh aspect of the present invention is a die cushion controlling method according to the eighth aspect, and the die cushion controlling method further includes: a step of outputting the standby position instruction values that are set from the die cushion position instructing unit before the test press so as to hold the cushion pad at the standby position, wherein the step of carrying out an adjustment is a step of adjusting, based on the acquired information, the offset value set in the offset adjusting device so as to hold the inclination of the cushion pad at the standby position of the cushion pad.

According to the eleventh aspect of the present invention, it is configured to acquire the information regarding the inclination of the cushion pad in the duration of the test press, and to adjust the offset value set in the offset adjusting device based on the acquired information regarding the inclination of the cushion pad. Through this configuration, it is possible to hold the cushion pad on standby at the standby position in parallel with the lower faces of the dies mounted to the slide of the press machine without adjusting the standby position instruction values.

According to a twelfth aspect of the present invention, in the die cushion controlling method according to the eleventh aspect, it is preferable that the step of adjusting the offset value is manually or automatically carried out.

According to a thirteenth aspect of the present invention, in the die cushion controlling method according to any one of the eighth to the twelfth aspect, it is preferable that the step of acquiring information regarding the inclination acquires the multiple position detected values outputted from the multiple die cushion position detecting devices as information regarding the inclination of the cushion pad, wherein the multiple position detected values are associated with each time in the duration of the die cushion force control, a position of the slide, or die cushion force applied onto the multiple driving shafts.

According to the present invention, in holding the cushion pad on standby at a desired standby position, it is possible to hold the cushion pad on standby in parallel with the lower faces of the dies mounted to the slide, and if the lower faces of the dies are inclined, it is possible to hold the cushion pad on standby in the state of being inclined. Through this configuration, it is possible to easily allow the material to come into contact with the lower faces of the dies from the beginning of the die cushion force control (beginning of the collision), and also possible to smoothen the die cushion action in the plane, thereby enhancing the formability.

DETAILED DESCRIPTION OF THE PREFERRED EMBODIMENTS

Hereinafter, preferred embodiments of a die cushion apparatus and a die cushion controlling method according to the present invention will be described with reference to the accompanying drawings.

<Structure of Press Machine>

Figure 1:
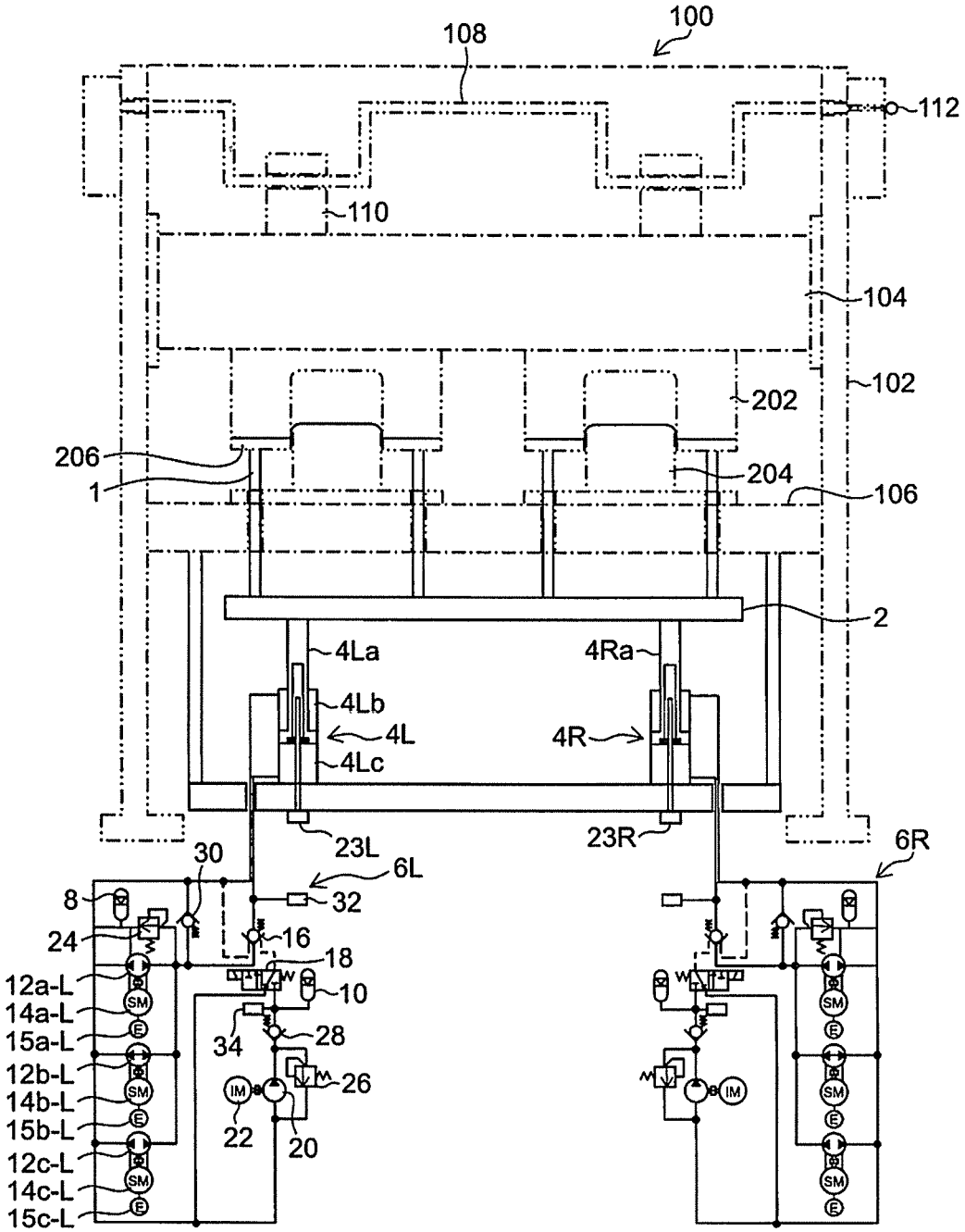
FIG. 1 is a configuration diagram showing an embodiment of a die cushion apparatus of a press machine according to the present invention.

FIG. 1 is a configuration diagram showing an embodiment of the die cushion apparatus of the press machine according to the present invention. It should be noted that a main configuration of the press machine is indicated by dot-dash lines.

The press machine 100 shown in FIG. 1 includes columns (frames) 102, a slide 104, a bed 106, a crank shaft 108, and connecting rods 110, etc., and the slide 104 is movably guided in the vertical direction by guide portions disposed to the columns 102. The crank shaft 108 is coupled to the slide 104 through the connecting rods 110. Rotational driving force is transmitted via a servo motor and a reduction gear mechanism, not shown in the drawing, to this crank shaft 108, and when the crank shaft 108 is rotated by the servo motor, the slide 104 is allowed to move in the vertical direction in FIG. 1 through driving force applied via the crank shaft 108 and the connecting rods 110.

The crank shaft 108 is provided with an angle detector 112 for detecting the angle of the crank shaft 108. An angular velocity signal can be obtained by dividing an angle signal outputted from the angle detector 112, but an angular velocity detector may be separately provided, instead.

Upper dies 202 are disposed to the lower face of the slide 104, and lower dies 204 are disposed to the upper face of the bed 106. The dies (the upper dies 202, and the lower dies 204) in this example are used for forming a hollow-cup shaped (drawing-pressed) product that are upwardly closed.

<Structure of Die Cushion Apparatus>

The die cushion apparatus mainly includes a cushion pad 2, oil hydraulic cylinders 4L, 4R that support the cushion pad 2, oil hydraulic circuits 6L, 6R that drive the respective oil hydraulic cylinders 4L, 4R, and a cushion control system 300 (FIG. 2) that controls the oil hydraulic circuits 6L, 6R.

Blank holding plates 206 are disposed between the upper dies 202 and the lower dies 204, the lower portions of the blank holding plates 206 are supported by the cushion pad 2 via multiple cushion pins 1, and a material is placed on (in contact with) the blank holding plates 206.

The oil hydraulic cylinders 4L, 4R function as a cushion pad raising and lowering device that raises and lowers the cushion pad 2 via piston rods (driving shafts) 4La, 4Ra, and also function as a die cushion force generating device that generates the die cushion force in the cushion pad 2. The oil hydraulic cylinders 4L, 4R are provided with die cushion position detectors 23L, 23R that detect positions in the extending and retracting direction of piston rods 4La, 4Ra of the oil hydraulic cylinders 4L, 4R as the position in the raising and lowering direction of the cushion pad 2. The die cushion position detector may be disposed between the bed 106 and the cushion pad 2, instead.

The configuration of the oil hydraulic circuit 6L for driving the oil hydraulic cylinder 4L will be described as follow.

The oil hydraulic circuit 6L includes accumulators 8, 10, oil hydraulic pumps/motors 12*a*-L, 12*b*-L, 12*c*-L, electric servo motors 14*a*-L, 14*b*-L, 14*c*-L connected to rotary shafts of the oil hydraulic pumps/motors 12*a*-L, 12*b*-L, 12*c*-L, angular velocity detectors 15*a*-L, 15*b*-L, 15*c*-L for detecting respective angular velocities of driving shafts of the electric servo motors 14*a*-L, 14*b*-L, 14*c*-L, a pilot operation check valve 16, an electromagnetic change-over valve 18, an electric (induction) motor 22 for driving an oil hydraulic pump 20, relief valves 24, 26, check valves 28, 30, and pressure detectors 32, 34.

The accumulator 8 having low gas pressure thereinside serves as a tank. One port of each of the oil hydraulic pumps/motors 12*a*-L, 12*b*-L, 12*c*-L is connected to a pressure chamber 4Lc on the raising side (pressure chamber on the cushion pressure generating side) of the oil hydraulic cylinder 4L via the pilot operation check valve 16, and the other port thereof is connected to the accumulator 8. The pressure chamber 4Lb on the lowering side (pressure chamber on the pad side) of the oil hydraulic cylinder 4L is connected to the accumulator 8.

The pilot operation check valve 16 opens its valve when the electromagnetic change-over valve 18 is changed over to apply oil pressure of the accumulator 10 on the high pressure side to the pilot operation check valve 16, and closes its valve when the oil pressure becomes decreased to the oil pressure of the accumulator 8 on the low pressure side. The pilot operation check valve 16 holds the cushion pad 2 at its position (by generating pressure equivalent to gravity affecting on the cushion pad 2 and its associated mass) during the non-controlling time such as at the time of an emergency stop. If an operator of the machine enters a die area for the sake of maintenance of the dies, or setting a material, the cushion pad 2 is limited to be held in this state. The pressure oil of the accumulator 10 in which high gas pressure is stored is used for the pilot operation. The accumulator 10 is supplied with the pressure oil from the oil hydraulic pump 20 driven by the electric motor 22 via the check valve 28, and the driving of the electric motor 22 is stopped if the pressure detector 34 detects high pressure at a certain level.

The electromagnetic change-over valve 18 is controlled not to apply the pilot pressure to the pilot operation check valve 16 at the time of an emergency stop caused by interruption of a light beam of a photoelectronic safety device during one cycle of the press-slide operation, or the like.

The pressure acting on the pressure chamber 4Lc on the cushion pressure generating side of the oil hydraulic cylinder 4L is detected by the pressure detector 32, and angular velocities of the electric servo motors 14*a*-L, 14*b*-L, 14*c*-L are detected by the respective angular velocity detectors 15*a*-L, 15*b*-L, 15*c*-L. The oil hydraulic circuit 6R that drives the right oil hydraulic cylinder 4R is configured in the same manner as the oil hydraulic circuit 6L, and the oil hydraulic cylinders 4L, 4R can be separately driven with these oil hydraulic circuits 6L, 6R.

[Principle of Die Cushion Force Control]

The die cushion force can be expressed by the product of the pressure of the pressure chambers on the cushion pressure generating side and the cylinder area of the oil hydraulic cylinders 4L, 4R; therefore, controlling the die cushion force means controlling the pressure of the pressure chambers on the cushion pressure generating side of the oil hydraulic cylinders 4L, 4R.

If the following are assumed:

cross sectional area of the oil hydraulic cylinder on the die cushion force generating side: A, volume of the oil hydraulic cylinder on the die cushion force generating side: V, die cushion force: P, electric (servo) motor torques: Ta, Tb, Tc, moment of inertia of the electric motors: Ia, Ib, Ic, coefficient of viscous resistance of the electric motors: DMa, DMb, DMc, friction torques of the electric motors: fMa, fMb, fMc, displacement volume of the oil hydraulic pumps/motors: Qa, Qb, Qc, force applied from the slide to the oil hydraulic cylinder piston rod: F, pad speed generated by push of the press: v, inertial mass of the oil hydraulic cylinder piston rod+the pad: M, coefficient of viscous resistance of the oil hydraulic cylinder: DS, friction force of the oil hydraulic cylinder: fS, angular velocity of the servo motors rotated by push of the pressure oil: ωa, ωb, ωc, bulk modulus of hydraulic oil: K, and constants of proportionality: k1, k2, the static behavior can be expressed by the following Formula 1 and Formula 2.

$$P=\int K((v\cdot A-k1(Qa\cdot\omega a+Qb\cdot\omega b+Qc\cdot\omega c))/V)dt \quad \text{[Formula 1]}$$

$$Ta=k2\cdot PQa/(2\pi),\ Tb=k2\cdot PQb/(2\pi),\ Tc=k2\cdot PQc/(2\pi) \quad \text{[Formula 2]}$$

The dynamic behavior can be expressed by the following Formula 3 and Formula 4 in addition to Formula 1 and Formula 2.

$$PA-F=M\cdot dv/dt+DS\cdot v+fS \quad \text{[Formula 3]}$$

$$Ta-k2\cdot PQa/(2\pi)=Ia\cdot d\omega a/dt+DMa\cdot\omega a+fMa$$

$$Tb-k2\cdot PQb/(2\pi)=Ib\cdot d\omega b/dt+DMb\cdot\omega b+fMb$$

$$Tc-k2\cdot PQc/(2\pi)=Ic\cdot d\omega c/dt+DMc\cdot\omega c+fMc \quad \text{[Formula 4]}$$

The above Formulas 1 to 4 mean that the force transmitted to the oil hydraulic cylinders 4L, 4R from the slide 104 via the cushion pad 2 compresses the pressure chamber on the cushion pressure generating side of the oil hydraulic cylinders 4L, 4R so as to generate the die cushion pressure. At the same time, the die cushion pressure force generates oil hydraulic motor action of the oil hydraulic pumps/motors 12*a*-L, 12*b*-L, 12*c*-L, and rotary shaft torques generated in the oil hydraulic pumps/motors 12*a*-L, 12*b*-L, 12*c*-L oppose driving torques of the electric servo motors 14*a*-L, 14*b*-L, 14*c*-L, which rotates (causes regenerative action onto) the electric servo motors 14*a*-L, 14*b*-L, 14*c*-L, thereby suppressing increase in pressure.

The die cushion force generated by the left oil hydraulic cylinder 4L is decided depending on the driving torques of the electric servo motors 14*a*-L, 14*b*-L, 14*c*-L. The die cushion force generated by the right oil hydraulic cylinder 4R can be controlled in the same manner.

[Control of Die Cushion Position]

The die cushion apparatus changes over the control state from a die cushion force control state to a die cushion position control state if the slide 104 is located in an area of a non-machining process. In the die cushion position control state, the electric servo motors 14*a*-L, 14*b*-L, 14*c*-L are controlled based on a die cushion position instruction value and a position detected value detected by the die cushion position detector 23L so as to supply the pressure oil from the oil hydraulic pumps/motors 12*a*-L, 12*b*-L, 12*c*-L to the pressure chamber on the raising side of the oil hydraulic cylinder 4L. Similarly, the pressure oil is supplied to the pressure chamber on the raising side of the oil hydraulic cylinder 4R based on the die cushion position instruction value and a position detected value detected by the die cushion position detector 23R.

Through this configuration, the positions of the piston rods 4La, 4Ra of the oil hydraulic cylinders 4L, 4R in the extending and retracting direction are controlled, thereby controlling the position of the cushion pad 2 in the raising and lowering direction (die cushion position).

The die cushion apparatus sequentially detects the die cushion position of the cushion pad 2 during one cycle of the press-slide operation by the die cushion position detectors 23L, 23R, and the position detected value indicating the detected die cushion position is outputted in association with each time in the duration of the die cushion force control, and the die cushion forces generated by the oil hydraulic cylinders 4L, 4R are sequentially calculated based on the detected output from the pressure detector 32, and the die cushion force calculated value indicating the calculated die cushion force is outputted in association with each time in the duration of the die cushion force control.

Figure 11:
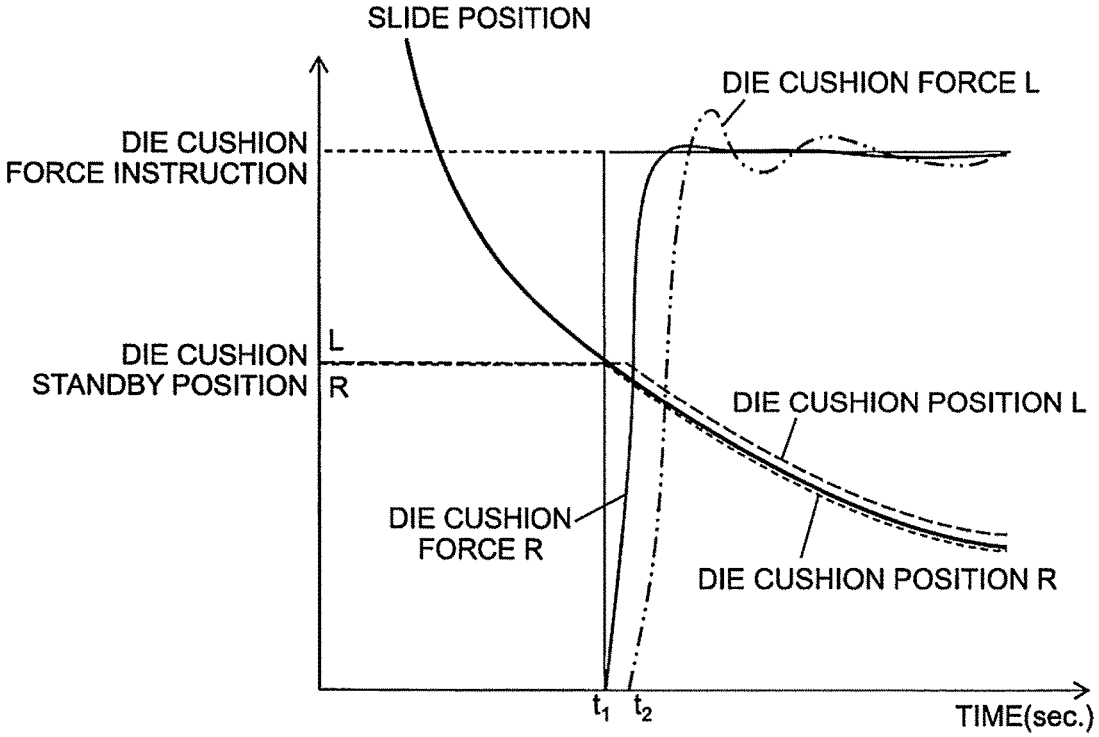
FIG.11 RELATED ART
FIG. 11 is a wave form chart showing left and right die cushion forces and left and right die cushion positions corresponding to a slide position in prior art.

Preferably, the output result of the position detected value and the die cushion force calculated value are outputted to a printer or a monitor that are not shown in the drawing as information indicating the state of the die cushion force control (graph shown in FIG. 11, for example).

The position detected value and the die cushion force calculated value are used at the time of controlling the die cushion position and controlling the die cushion force, and may also be used at the time of setting the standby position of the cushion pad 2 described later.

[Cushion Control System (First Embodiment)]

Figure 2:
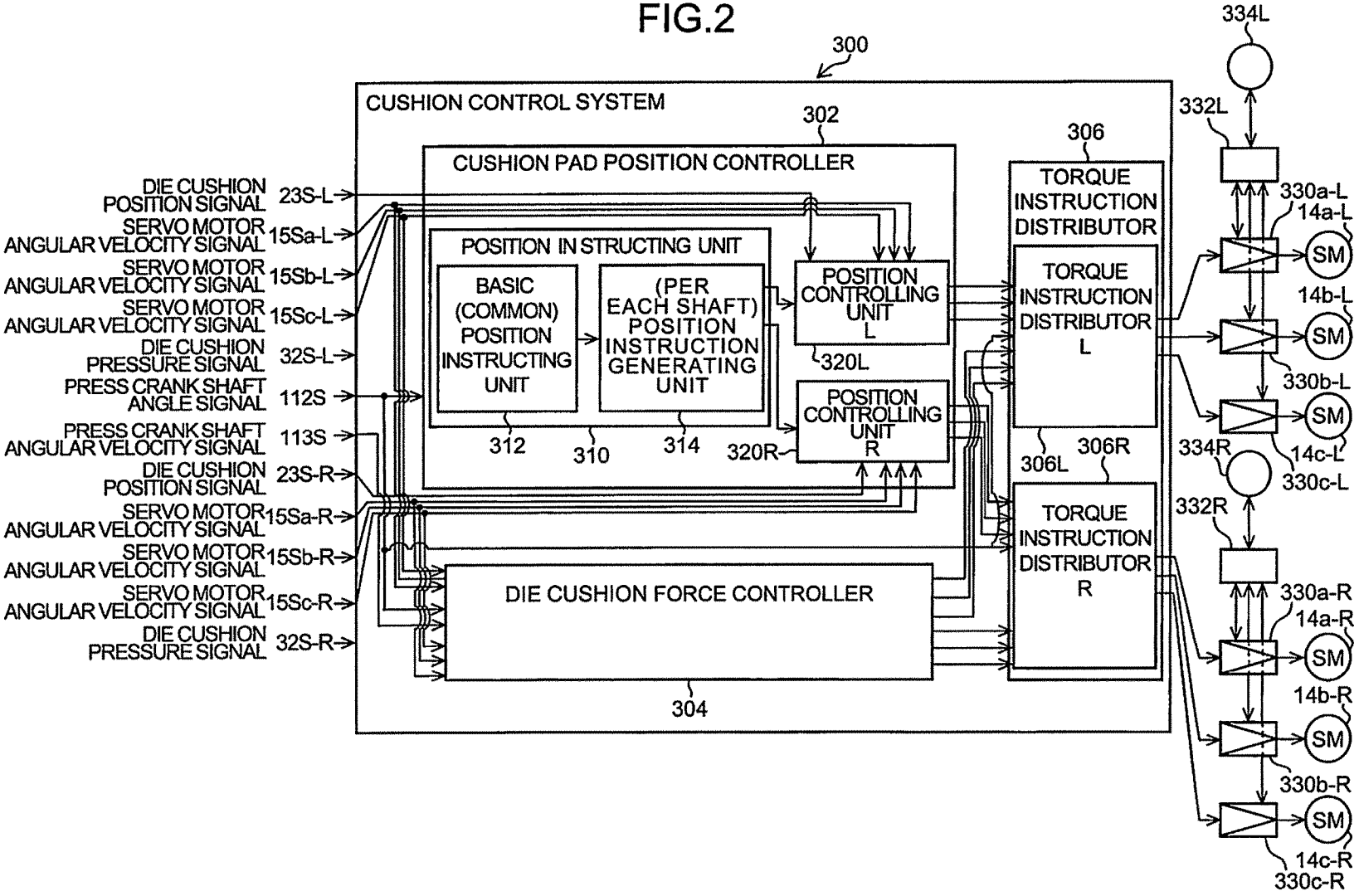
FIG. 2 is a block diagram showing a first embodiment of a cushion control system in the cushion apparatus shown in FIG. 1.

FIG. 2 is a block diagram showing the first embodiment of the cushion control system in the die cushion apparatus shown in FIG. 1.

The cushion control system 300 shown in FIG. 2 mainly includes a cushion pad position controller 302, a die cushion force controller 304, and a torque instruction distributor 306.

The cushion pad position controller 302 includes a position instructing unit 310 and position controlling units 320L, 320R, and the position instructing unit 310 includes a basic position instructing unit 312 and a position instruction generating unit 314 for generating a position instruction value for each driving shaft.

The cushion pad position controller 302 and the die cushion force controller 304 receive a press crank shaft angle signal 112S from the angle detector 112 for detecting the angle of the crank shaft 108 so as to obtain timing of starting the die cushion function (start of the position control, start of the pressure control), and the slide position during the pressure control, and also receive a press crank shaft angular velocity signal 113S for the sake of securing dynamic stability in the die cushion force control by the die cushion force controller 304.

The basic position instructing unit 312 of the cushion pad position controller 302 outputs a position instruction value that is a position instruction value which instructs a position in the raising and lowering direction of the cushion pad 2 based on the press crank shaft angle signal 112S and a user's setting value such as knock out speed, and which at least includes a standby position instruction value for holding the cushion pad 2 at the standby position.

The position instruction generating unit 314 generates a position instruction value for each of the driving shafts of the oil hydraulic cylinders 4L, 4R, and adds a previously-set offset value for each driving shaft to the position instruction value outputted from the basic position instructing unit 312, thereby generating a position instruction value that is offset. The method of setting the offset value to the position instruction generating unit 314 will be described later.

The position instruction value for each of the driving shafts of the oil hydraulic cylinders 4L, 4R outputted from the position instruction generating unit 314 is respectively outputted to the position controlling units 320L and 320R.

In addition to the above input, the position controlling unit 320L receives a position detected value (die cushion position signal 23S-L) corresponding to the position of the driving shaft of the oil hydraulic cylinder 4L from the die cushion position detector 23L, and servo motor angular velocity signals 15Sa-L, 15Sb-L, 15Sc-L indicating angular velocities of the driving shafts of the electric servo motors 14*a*-L, 14*b*-L, 14*c*-L from the angular velocity detectors 15*a*-L, 15*b*-L, 15*c*-L of the left oil hydraulic circuit 6L; and the position controlling unit 320L outputs to a torque instruction distributor 306L a torque instruction value based on deviation between a position instruction value inputted from the position instruction generating unit 314 and the die cushion position signal 23S-L that is a position feedback signal. The servo motor angular velocity signals 15Sa-L, 15Sb-L, 15Sc-L are used for enhancing responsibility and stability of the control system, and also enhancing accuracy of the control by reducing steady-state deviation.

Similarly, the position controlling unit 320R receives a position instruction value for each driving shaft of the oil hydraulic cylinder 4R inputted from the position instruction generating unit 314, a die cushion position signal 23S-R, and servo motor angular velocity signals 15Sa-R, 15Sb-R, 15Sc-R from the angular velocity detecting units 15*a*-R, 15*b*-R, 15*c*-R, and outputs a torque instruction value calculated based on these inputted signals to a torque instruction distributor 306R.

Meanwhile, the die cushion force controller 304 includes a die cushion force instructing unit (not shown) that outputs an appropriate die cushion force instruction value based on the inputted press crank shaft angle signal 112S (corresponding to a slide position signal), and the die cushion force controller 304 calculates torque instruction values for the left electric servo motors 14*a*-L, 14*b*-L, 14*c*-L, and the torque instruction values for the right electric servo motors 14*a*-R, 14*b*-R, 14*c*-R based on die cushion force instruction value, the press crank shaft angle signal 112S, the press crank shaft angular velocity signal 113S, and die cushion pressure signals 32S-L, 32S-R indicating the respective pressures of the pressure chambers on the cushion pressure generating side of the oil hydraulic cylinders 4L, 4R, which are detected by the left and right pressure detectors 32, and the die cushion force controller 304 outputs the respective torque instruction values to the torque instruction distributors 306L, 306R.

Based on the press crank shaft angle signal 112S, the torque instruction distributors 306L, 306R selectively output the torque instruction values inputted from the position controlling units 320L, 320R in the die cushion position control state, and selectively output the torque instruction values inputted from the die cushion force controller 304 in the die cushion force control state.

The respective torque instruction values for the electric servo motors 14*a*-L, 14*b*-L, 14*c*-L, which are outputted from the torque instruction distributor 306L, are outputted to the electric servo motors 14*a*-L, 14*b*-L, 14*c*-L via amplifier-pulse width modulation (PWM) controllers 330*a*-L, 330*b*-L, 330*c*-L. Through this configuration, the control (i.e., the die cushion position control or the die cushion force control) on the left oil hydraulic cylinder 4L is carried out.

The respective torque instruction values for the electric servo motors 14*a*-R, 14*b*-R, 14*c*-R, which are outputted from the torque instruction distributor 306R, are outputted to the electric servo motors 14*a*-R, 14*b*-R, 14*c*-R via the amplifier-PWM controllers 330*a*-R, 330*b*-R, 330*c*-R. Through this configuration, the die cushion position control or the die cushion force control on the right oil hydraulic cylinder 4R is carried out.

During the die cushion force control, when the oil hydraulic pumps/motors 12*a*-L, 12*b*-L, 12*c*-L operate as the oil hydraulic motors, the electric servo motors 14*a*-L, 14*b*-L, 14*c*-L operate as generators via the oil hydraulic pumps/motors 12*a*-L, 12*b*-L, 12*c*-L. Electric power generated by the electric servo motors 14*a*-L, 14*b*-L, 14*c*-L is regenerated by an AC power supply 334L via the amplifier-PWM controllers 330*a*-L, 330*b*-L, 330*c*-L and a power supply 332L having a power-regenerating function.

Similarly, during the die cushion force control, the oil hydraulic pumps/motors 12*a*-R, 12*b*-R, 12*c*-R operate as the oil hydraulic motors, the electric servo motors 14*a*-R, 14*b*-R, 14*c*-R operate as generators via the oil hydraulic pumps/motors 12*a*-R, 12*b*-R, 12*c*-R, and electric power generated by the electric servo motors 14*a*-R, 14*b*-R, 14*c*-R is regenerated by an AC power supply 334R via the amplifier-PWM controllers 330*a*-R, 330*b*-R, 330*c*-R and a power supply 332R having a power-regenerating function.

[Die Cushion Controlling Method (First Embodiment)]

The die cushion controlling method (first embodiment) applied to the cushion control system of the first embodiment will be described, hereinafter.

Figure 3:
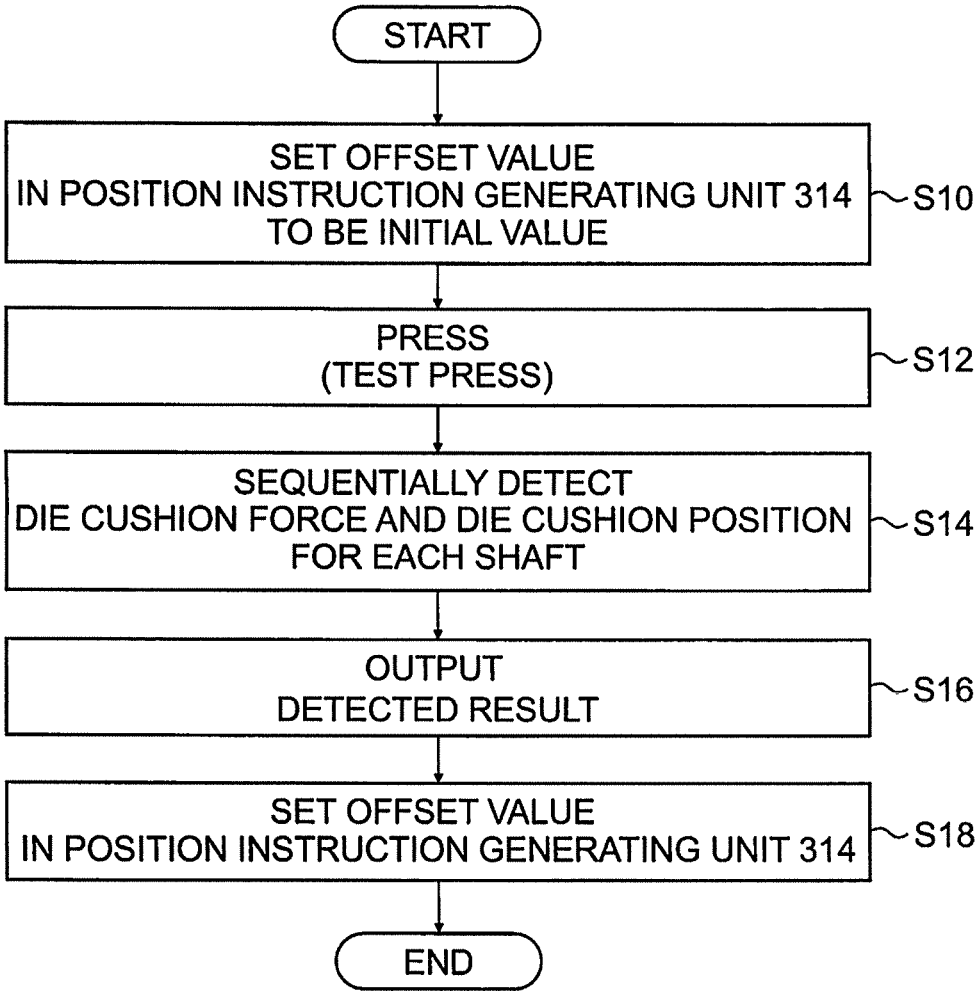
FIG. 3 is a flow chart showing the first embodiment of a die cushion controlling method according to the present invention.

FIG. 3 is a flow chart showing the first embodiment of the die cushion controlling method.

As shown in FIG. 3, the offset value set in the position instruction generating unit 314 shown in FIG. 2 is set as an initial value (step S10). As aforementioned, the position instruction generating unit 314 generates the position instruction value for each driving shaft of the oil hydraulic cylinders 4L, 4R, and adds the previously-set offset value for each driving shaft to the position instruction value outputted from the basic position instructing unit 312, thereby generating the position instruction value that is offset. Specifically, the position instruction generating unit 314 includes offset setting units each of which manually carries out the offset adjustment of the position instruction value for each of the driving shafts of the oil hydraulic cylinders 4L, 4R, and sets an appropriate offset value in each offset setting unit, thereby outputting the position instruction values after the offset (individual position instruction value for each driving shaft).

Figure 10A:
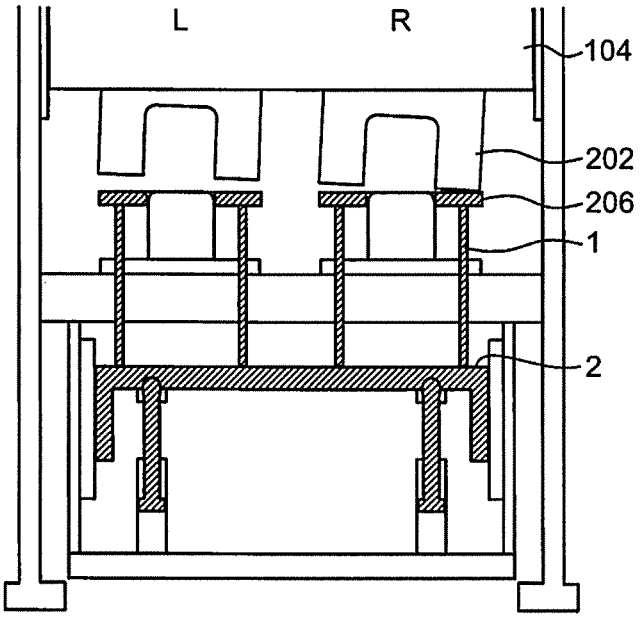
FIG.10A RELATED ART
FIG. 10A is a schematic diagram showing a cushion pad, etc., at a die cushion standby position in the prior art.

In step S10, the offset value set in each offset setting unit of the position instruction generating unit 314 is set as an initial value (e.g., "0"). If the offset value is set to be "0," a common position instruction value outputted from the basic position instructing unit 312 is outputted as the position instruction value for each of the driving shafts of the oil hydraulic cylinders 4L, 4R outputted from the position instruction generating unit 314. If the die cushion standby position instruction value indicating the standby position of the cushion pad 2 is outputted as the common position instruction value outputted from the basic position instructing unit 312, the cushion pad 2 moves to the die cushion standby position. If the offset value is "0," the plane face of the cushion pad 2 is set to be parallel with the lower face of the slide 104 (see FIG. 10A).

Subsequently, the material is set on the upper face of the blank holding plate 206, and the press machine is operated by one cycle so as to press the material (test press) (step S12).

The cushion apparatus is changed over to the die cushion position control if a crank-angle-equivalent slide position is located from a top dead center to a position where the lower faces of the upper dies 202 collide with the material, and located in a non-machining area from a bottom dead center to the top dead center, and the cushion apparatus is changed over to the die cushion force control if the crank-angle-equivalent slide position is located in the machining area from the position where the lower faces of the upper dies 202 collide with the material to the bottom dead center.

During one cycle operation of the press machine, the pressure of the pressure chamber on the cushion force generating side of the oil hydraulic cylinders 4L, 4R, or the die cushion force acting on each of the driving shafts of the oil hydraulic cylinders 4L, 4R, which is converted from the detected pressure, is sequentially detected by the left and right pressure detectors 32, and the position of each of the driving shafts (die cushion positions) of the oil hydraulic cylinders 4L, 4R is sequentially detected by the die cushion position detectors 23L, 23R (step S14). The die cushion pressure signals 32S-L, 32S-R outputted from the left and right pressure detectors 32, and the die cushion position signals 23S-L, 23S-R indicating the die cushion position for each of the driving shafts of the oil hydraulic cylinders 4L, 4R, which are outputted from the die cushion position detectors 23L, 23R, are used as feedback signals during the die cushion force control and the die cushion position control as described in FIG. 2, as well as used for checking the behavior of the die cushion apparatus.

Specifically, the die cushion pressure signals 32S-L, 32S-R, and the die cushion position signals 23S-L, 23S-R, which are detected in step S14, are outputted as a time-series detected result in association with each time in the duration of the die cushion force control (step S16).

The detected result outputted in step S16 is outputted as information indicating a state of the die cushion force control to a printer or a monitor. Preferably, the detected result is outputted as a print output or a monitor output in a graph as shown in FIG. 11.

Delay of startup of the die cushion forces L, R that act on the driving shafts of the oil hydraulic cylinders 4L, 4R at the collision (impact) time is checked with reference to the above detected result (graph in FIG. 11 and others), and the offset value to be set in the offset setting unit of the position instruction generating unit 314 is adjusted such that the die cushion forces L, R simultaneously start up (step S18).

If the detected result shown in the graph of FIG. 11 is obtained, it is understood that the die cushion force R acting on the driving shaft of the oil hydraulic cylinder 4R starts up at the time $t_1$, and thereafter, the die cushion force L acting on the driving shaft of the oil hydraulic cylinder 4L starts up at the time $t_2$. It is also understood that the left and right die cushion positions L, R vary with a constant difference therebetween.

Figure 10B:
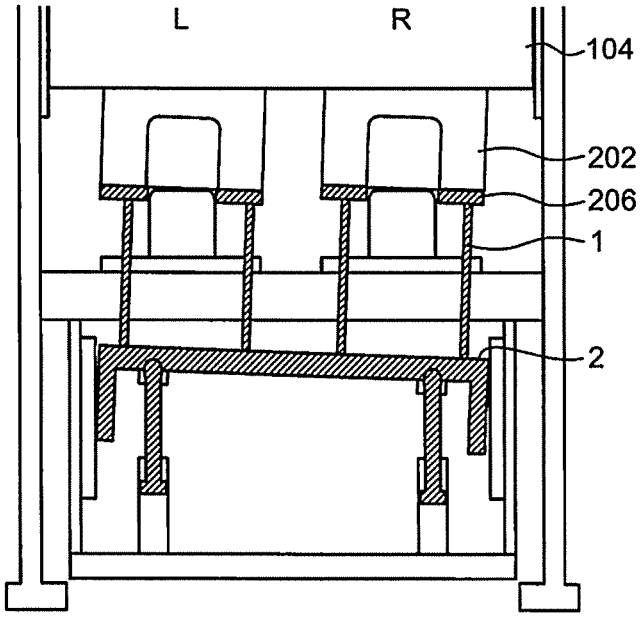
FIG.10B RELATED ART
FIG. 10B is a schematic diagram showing the cushion pad, etc., at the start of a die cushion force control in the prior art.

This is because the lower faces of the upper dies 202 are inclined, so that the right upper die 202 precedingly collides, and the left upper die 202 subsequently collides. The left and right die cushion positions L, R vary with a constant difference therebetween because the cushion pad 2 becomes inclined in accordance with the inclination of the upper dies 202, and moves in this inclination state (see FIG. 10B).

In the die cushion controlling method of the first embodiment, in a state where the cushion pad 2 is on standby at the die cushion standby position, the offset value to be set in the position instruction generating unit 314 is adjusted such that the left and right die cushion positions L, R previously have a constant difference therebetween (become parallel with the inclined lower faces of the upper dies 202). Specifically, the difference between the left and right die cushion positions L, R at a certain time in the duration of the die cushion force control (preferably, immediately after the left and right die cushion forces L, R start up) is read out from the detected result, and this difference is set in the position instruction generating unit 314 as the offset value.

For example, it is assumed that the detected result shown in the graph of FIG. 11 is obtained, and in order to match the time $t_2$ when the die cushion force L acting on the driving shaft of the oil hydraulic cylinder 4L starts up to the time $t_1$, the offset value is adjusted such that the die cushion standby position in the driving shaft of the oil hydraulic cylinder 4L becomes higher by the difference between the die cushion positions L, R at the time of startup of the left and right die cushion forces L, R. Specifically, the offset value to be set in the position instruction generating unit 314 is adjusted based on the difference between the left and right die cushion positions L, R at the time of startup of the left and right die cushion forces L, R.

Figure 4A:
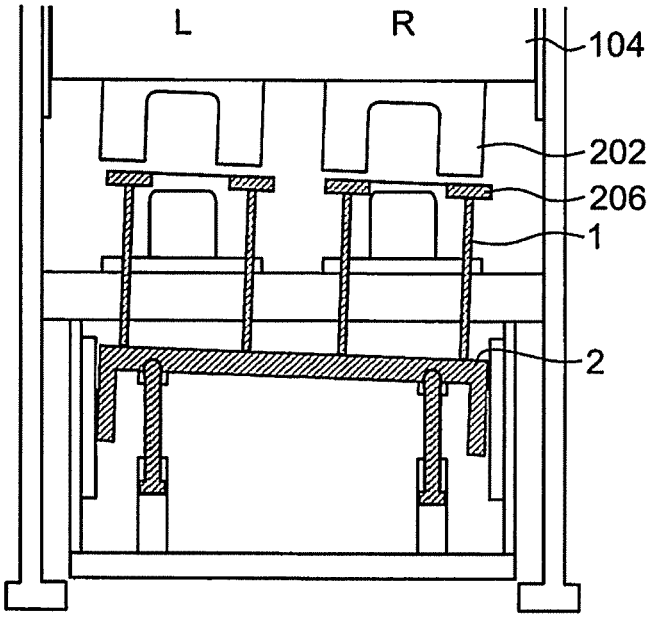
FIG. 4A is a schematic diagram showing a cushion pad, etc., at a die cushion standby position after a die cushion position adjustment according to the present invention.

By adjusting the offset value to be set in the position instruction generating unit 314 in the above manner, different position instruction values are outputted as the position instruction value for each of the driving shafts of the oil hydraulic cylinders 4L, 4R, thereby allowing the upper face of the cushion pad 2 (blank holding plate 206) on standby at the die cushion standby position to be inclined in parallel with the lower face of the upper dies 202 mounted to the slide 104 as shown in FIG. 4A.

Figure 4B:
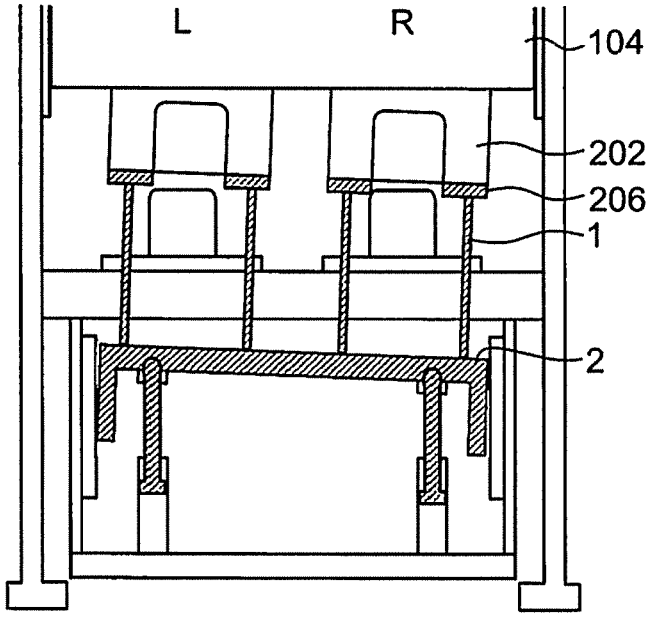
FIG. 4B is a schematic diagram showing the cushion pad, etc., at the start of a die cushion force control according to the present invention.
Figure 5:
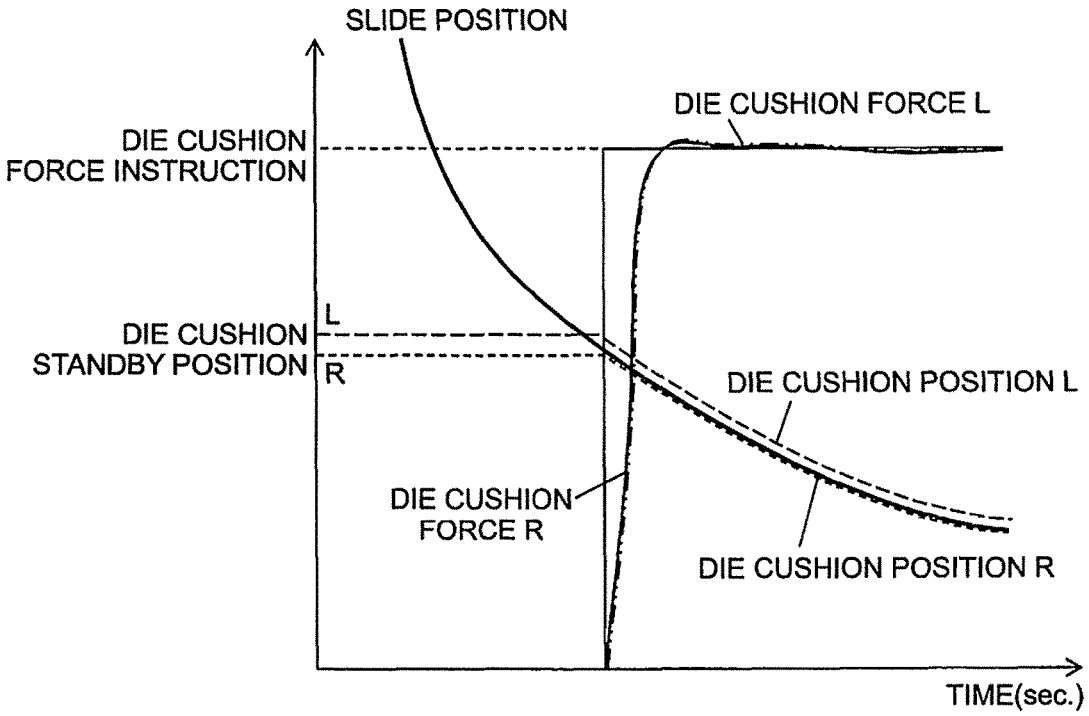
FIG. 5 is a wave form chart showing the die cushion forces and die cushion positions on the left and the right corresponding to the slide position after the die cushion standby position adjustment according to the present invention.

Consequently, as shown in FIG. 4B, the lower faces of the left and right upper dies 202 simultaneously collide with the material placed on the blank holding plate 206 at the time of startup of the die cushion force control, so that the left and right die cushion forces L, R of the cushion pad 2 simultaneously start up, thereby preventing a difference between the left and right die cushion forces L, R, as shown in FIG. 5.

Preferably, a test press is carried out after the offset value adjustment shown in FIG. 3 for the purpose of refine adjustment of the offset value. It may be configured that a reference position instruction value is always outputted as one of the two position instruction values, and only the other position instruction value may be subjected to the offset adjustment, and then be outputted. In this case, only one offset setting unit is required. In addition, in the first embodiment, the position instructing unit 310 is configured to add the (basic) position instruction value outputted from the basic position instructing unit 312 and the offset value for each driving shaft set in the position instruction generating unit 341, thereby outputting the position instruction value for each driving shaft, but the present invention is not limited to this, and each driving shaft may be equipped with an separate position instructing unit. In this case, each position instructing unit is required to have an adjustment function for adjusting each position instruction value.

[Cushion Control System (Second Embodiment)]

Figure 6:
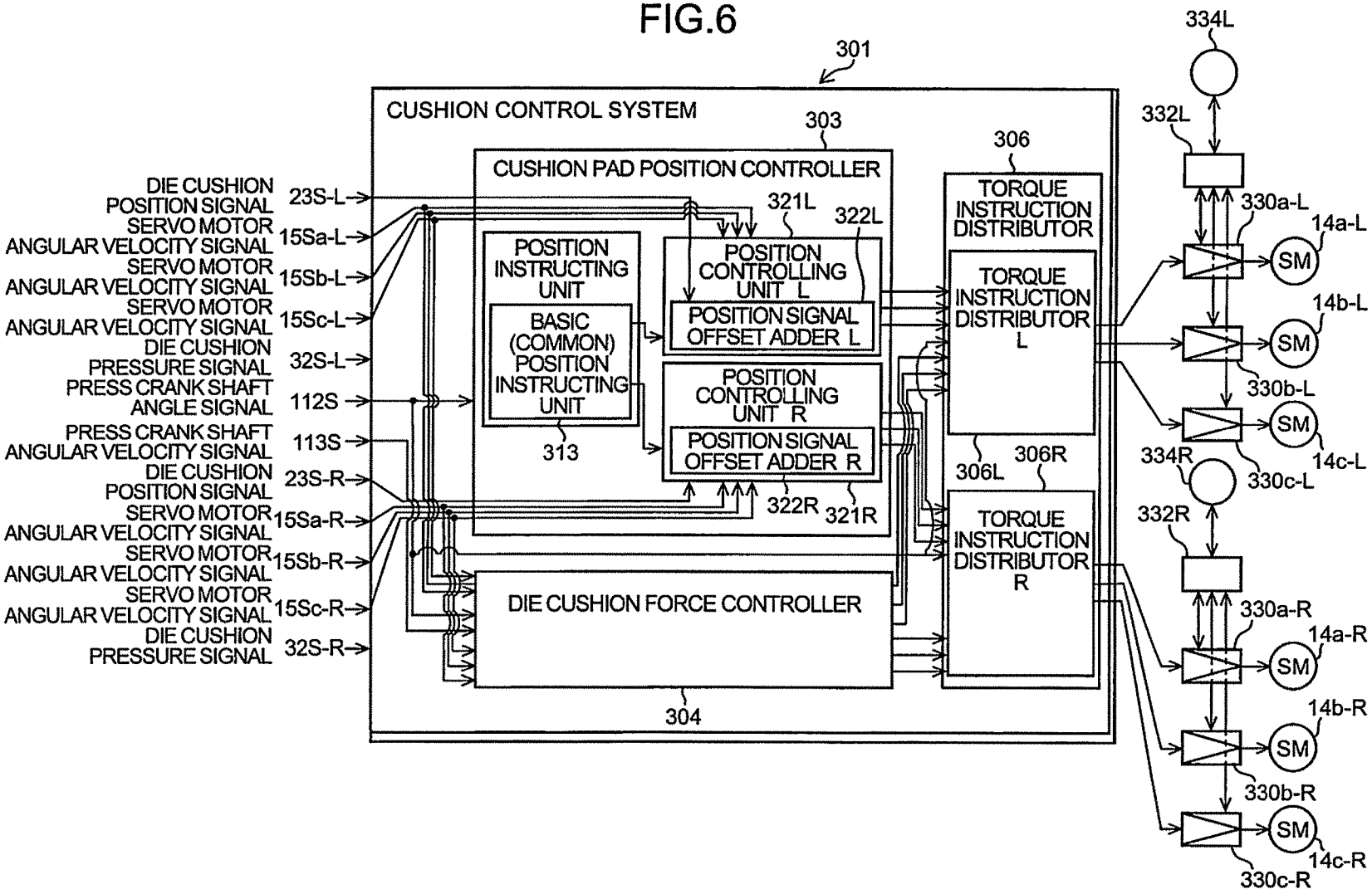
FIG. 6 is a block diagram showing a second embodiment of the cushion control system in the die cushion apparatus shown in FIG. 1.

FIG. 6 is a block diagram showing the second embodiment of the cushion control system in the die cushion apparatus shown in FIG. 1.

The cushion control system 301 of the second embodiment shown in FIG. 6 has a difference only in a cushion pad position controller 303 compared with the cushion control system 300 of the first embodiment shown in FIG. 2. Hence, in the cushion control system 301 of the second embodiment, structural elements substantially the same as those in the first embodiment are denoted with the same reference numerals, and repeated explanation thereof is omitted.

The cushion control system 300 of the first embodiment has such a configuration that separately adjusts and outputs the position instruction value for each of the driving shafts of the left and right oil hydraulic cylinders 4L, 4R; but the cushion control system 301 of the second embodiment is different from the first embodiment in the following feature: the die cushion position signals 23S-L, 23S-R indicating the position of each of the driving shafts (die cushion positions) of the left and right oil hydraulic cylinders 4L, 4R can be separately adjusted and outputted. Specifically, the die cushion position signals 23S-L, 23S-R are used as the position feedback signals at the time of the die cushion position control, and respective offset values are added to these die cushion position signals 23S-L, 23S-R, thereby controlling the die cushion positions for the driving shafts of the left and right oil hydraulic cylinders 4L, 4R to become different positions with respect to the common position instruction value.

The cushion pad position controller 303 will be described, hereinafter.

The cushion pad position controller 303 includes a position instructing unit (basic position instructing unit) 313, and position controlling units 321L, 321R.

The basic position instructing unit 313 outputs a position instruction value including the standby position instruction value of the cushion pad 2 based on the press crank shaft angle signal 112S and the user's setting value such as knock out speed, as similarly to the basic position instructing unit 312 shown in FIG. 2. The common position instruction value outputted from the basic position instructing unit 313 is added to the respective position controlling units 321L, 321R.

In addition to the above input, the position controlling unit 321L receives a position detected value corresponding to the position of the driving shaft (die cushion position signal 23S-L) of the oil hydraulic cylinder 4L from the die cushion position detector 23L, and servo motor angular velocity signals 15Sa-L, 15Sb-L, 15Sc-L indicating angular velocities of the driving shafts of the electric servo motors 14*a*-L, 14*b*-L, 14*c*-L from the angular velocity detectors 15*a*-L, 15*b*-L, 15*c*-L of the left oil hydraulic circuit 6L; and the position controlling unit 321L outputs torque instruction values for driving the electric servo motors 14*a*-L, 14*b*-L, 14*c*-L based on these inputted signals so as to control the position of the driving shaft of the oil hydraulic cylinder 4L.

Figure 7:
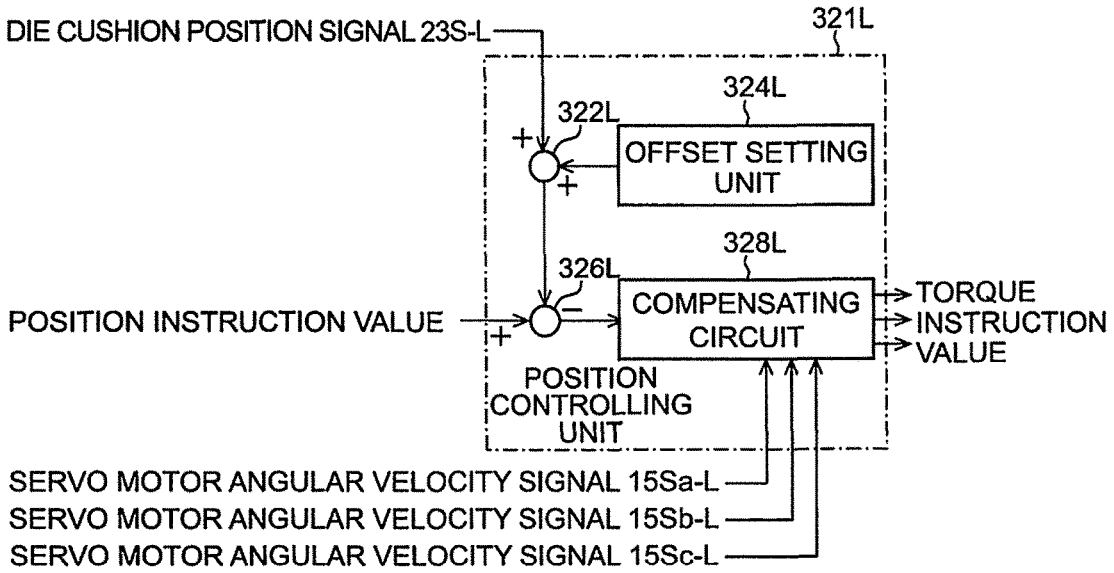
FIG. 7 is a block diagram showing an example of an inner configuration of a position controlling unit 321L shown in FIG. 6.

FIG. 7 is a block diagram showing an inner configuration of the position controlling unit 321L. As shown in FIG. 7, a position controlling unit 321L mainly includes adders 322L, 326L, an offset setting unit 324L, and a compensating circuit 328L.

A position detected value (die cushion position signal 23S-L) corresponding to a position of the driving shaft of the oil hydraulic cylinder 4L from the die cushion position detector 23L, and the offset value set by the offset setting unit 324L are inputted to two positive inputs of the adder (offset adder) 322L, and the adder 322L adds these two input values, and outputs this value to a negative input of the adder 326L. Through this processing, the adder 322L adds the offset value set in the offset setting unit 324L to the die cushion position signal 23S-L as the position feedback signal, and outputs the die cushion position signal 23S-L that is offset. It is configured that the offset value can be manually set in offset setting unit 324L, and the offset setting unit 324L outputs the above set offset value to the adder 322L.

The position instruction value from the basic position instructing unit 312 is added to a positive input of the adder 326L, and the adder 326L finds deviation between these two input signals, and outputs a signal regarding this deviation to the compensating circuit 28L. The compensating circuit 328L includes compensating elements such as proportional compensation and integral compensation, determines the torque instruction values for driving the electric servo motors 14*a*-L, 14*b*-L, 14*c*-L based on the inputted deviation signal, and outputs the determined torque instruction value. The servo motor angular velocity signals 15Sa-L, 15Sb-L, 15Sc-L are added to the compensating circuit 328L, and the compensating circuit 328L uses the servo motor angular velocity signals 15Sa-L, 15Sb-L, 15Sc-L so as to enhance responsibility and stability of the control system, as well as to reduce steady-state deviation, thereby enhancing accuracy of the control.

The position controlling unit 321R has the same configuration as that of the position controlling unit 321L, and outputs the torque instruction values for driving the electric servo motors 14*a*-R, 14*b*-R, 14*c*-R.

[Die Cushion Controlling Method (Second Embodiment)]

The die cushion controlling method (second embodiment) applied to the cushion control system of the second embodiment will be described, hereinafter.

Figure 8:
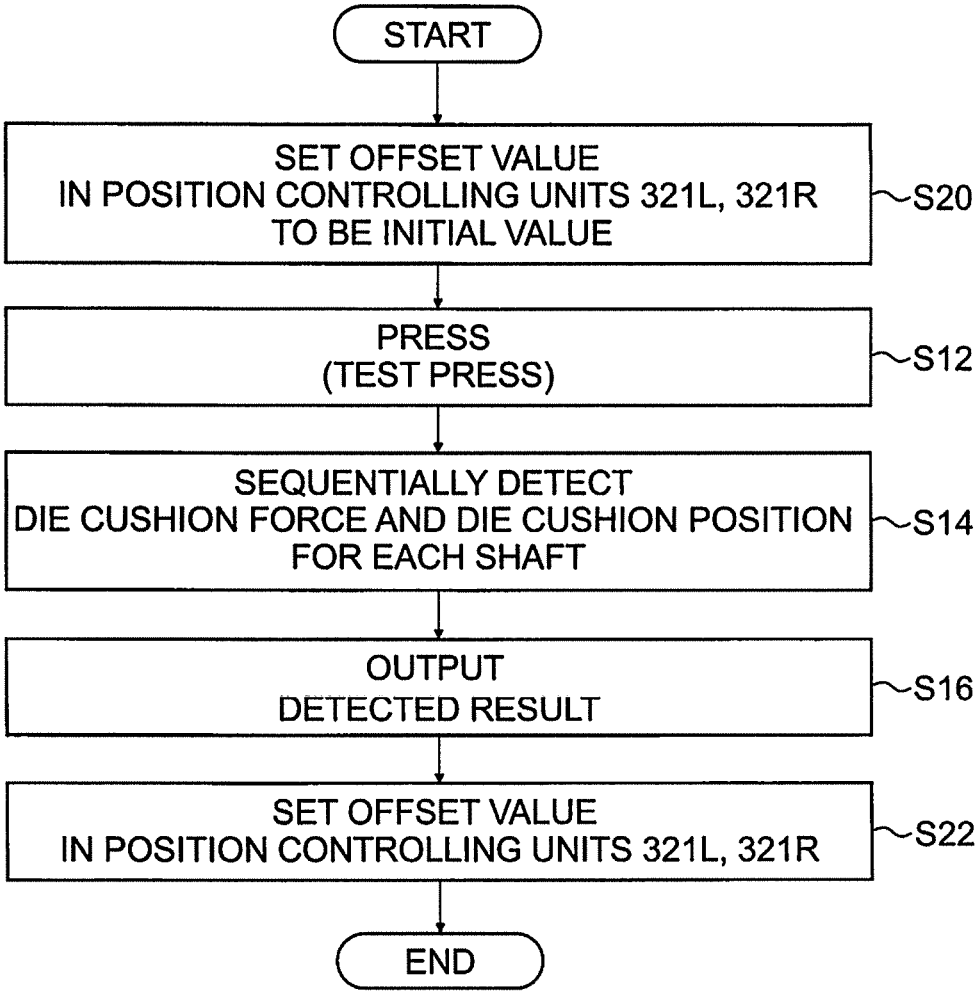
FIG. 8 is a flow chart showing the second embodiment of a die cushion controlling method.

FIG. 8 is a flow chart showing the second embodiment of the die cushion controlling method. In FIG. 8, common flows to those in the flow chart showing the first embodiment of the die cushion controlling method shown in FIG. 3 are denoted with the same step numbers, and repeated explanation thereof is omitted.

The second embodiment of the die cushion controlling method shown in FIG. 8 is different in the following feature: this die cushion controlling method carries out the processing in step S20 and in step S22 instead of the processing in step S10 and step S18 in the flow chart of FIG. 3.

In step S20, the offset values set in the position controlling units 321L, 321R shown in FIG. 6 are set as initial values. The initial value for the offset value set in each offset setting unit (see FIG. 7) of the position controlling units 321L, 321R is set to be "0," thereby setting the plane face of the cushion pad 2 to be parallel with the lower face of the slide 104, as similarly to the first embodiment.

In step S22, the deviation between the left and right die cushion positions L, R during the die cushion force control is read out from the detected result of the left and right die cushion positions L, R that is detected at the time of the test press, and each offset value set in the position controlling units 321L, 321R is set (adjusted) such that this deviation becomes zero.

For example, it is assumed that the detected result shown in the graph of FIG. 11 is obtained, and in order to match the time $t_2$ when the die cushion force L acting on the driving shaft of the oil hydraulic cylinder 4L starts up to the time $t_1$, the offset values in the position controlling units 321L, 321R are set such that the die cushion standby position in the driving shaft of the oil hydraulic cylinder 4L becomes higher by a differential value between the left and right die cushion positions L, R. Specifically, the offset value for reducing the die cushion position signal 23S-L by the differential value is set in the offset setting unit 324L (FIG. 7) of the position controlling unit 321L as the offset value.

By respectively adjusting the offset values set in the position controlling units 321L, 321R in the above manner, the die cushion position signals 23S-L, 23S-R used as the position feedback signals are separately offset, thereby allowing the upper face of the cushion pad 2 (blank holding plate 206) on standby at the die cushion standby position to be inclinedly held on standby in parallel with the lower faces of the upper dies 202 mounted to the slide 104 as shown in FIG. 4A.

Only one of the position controlling units 321L, 321R may have the function of offset-adjusting the die cushion position signal, and in this case, the other position controlling unit may be a normal position controlling unit having no offset-adjusting function.

[Cushion Control System (Third Embodiment)]

The cushion control system 300 of the first embodiment has such a configuration that manually and separately adjusts and outputs the position instruction value for each of the driving shafts of the left and right oil hydraulic cylinders 4L, 4R; but the cushion control system according to the third embodiment has a configuration of automatically adjusting and outputting the position instruction value for each of the driving shafts of the left and right oil hydraulic cylinders 4L, 4R.

The configuration of the position instruction generating unit is the only difference between the cushion control system of the third embodiment and the cushion control system 300 of the first embodiment; therefore, only the position instruction generating unit of the cushion control system of the third embodiment will be described, hereinafter.

Figure 9:
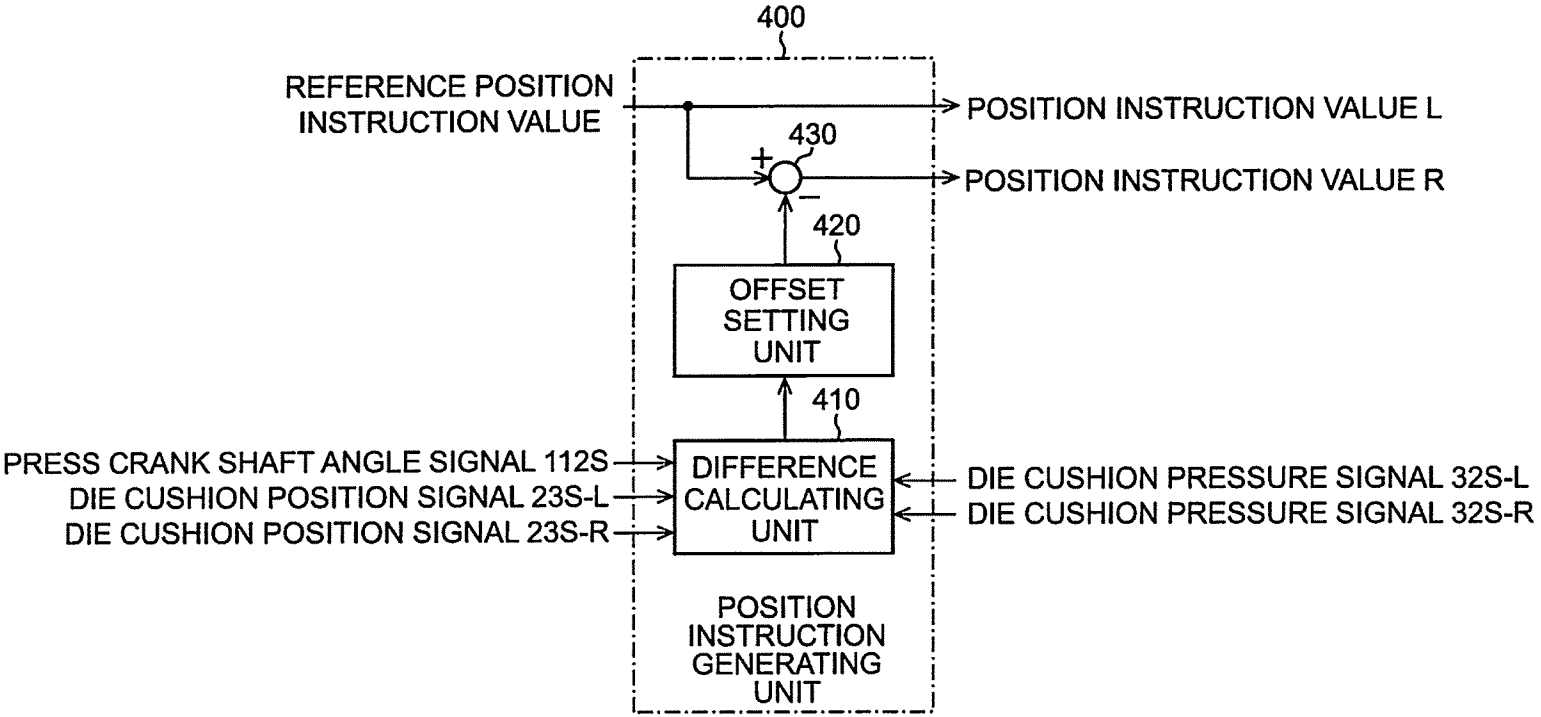
FIG. 9 is a block diagram showing an example of a configuration of a position instruction generating unit included in the cushion control system of a third embodiment.

FIG. 9 is a block diagram showing an example of the configuration of the position instruction generating unit included in the cushion control system according to the third embodiment.

The position instruction generating unit 400 shown in FIG. 9 mainly includes a difference calculating unit 410, an offset setting unit 420, and an offset adder 430.

The press crank shaft angle signal 112S, the die cushion position signals 23S-L, 23S-R, and the die cushion pressure signals 32S-L, 32S-R are added to the difference calculating unit 410. The difference calculating unit 410 detects an appropriate timing (for example, timing immediately after the left and right die cushion forces L, R start up) during the die cushion force control from the press crank shaft angle signal 112S and the die cushion pressure signals 32S-L, 32S-R, and acquires the die cushion position signals 23S-L, 23S-R at the detected timing. The difference calculating unit 410 calculates a differential value between the die cushion position signals 23S-L, 23S-R that are acquired. In the present embodiment, the differential value is calculated by subtracting the die cushion position signal 23S-R from the die cushion position signal 23S-L, and the calculated differential value is outputted to the offset setting unit 420.

The offset setting unit 420 automatically sets the differential value inputted from the difference calculating unit 410 as the offset value, and outputs the above-set offset value (differential value) to a negative input of the offset adder 430.

The reference position instruction value outputted from the basic position instructing unit 312 (FIG. 2) is outputted as a position instruction value L for the driving shaft of the left oil hydraulic cylinder 4L, and is also added to a positive input of the offset adder 430. The offset adder 430 corrects the reference position instruction value by subtracting the offset value from the reference position instruction value, and outputs the corrected reference position instruction value as a position instruction value R for the driving shaft of the right oil hydraulic cylinder 4R.

This configuration allows the position instruction generating unit 400 to automatically adjust the offset value added to the reference position instruction value in the duration of the test press, and to output different position instruction values L, R for the respective driving shafts of the oil hydraulic cylinders 4L, 4R. If the position instruction generating unit 400 receives the die cushion standby position instruction value as the reference position instruction value from the basic position instructing unit 312, the position instruction generating unit 400 can output the position instruction values L, R for holding the upper face of the cushion pad 2 (blank holding plate 206) on standby in parallel with the lower faces of the upper dies 202 mounted to the slide 104.

In the third embodiment, it is configured to automatically sets the offset value, which is manually set by the position instruction generating unit 314 in the first embodiment; and as similarly to the third embodiment, it may be configured to automatically set the offset values, which are manually set by the position controlling unit 321L, 321R in the second embodiment, as a variation of the third embodiment.

[Variation]

The die cushion apparatus of the above embodiment has the oil hydraulic cylinders 4L, 4R at two positions of left and right of the cushion pad 2, but the present invention may be applicable to any die cushion apparatus having the cushion pad provided with multiple oil hydraulic cylinders. For example, the present invention may also be applicable to such a die cushion apparatus that has oil hydraulic cylinders at four positions in right and left direction and in the front and back direction of the cushion pad. In this case, the position and inclination of the cushion pad during the die cushion force control can be identified by detecting the die cushion positions corresponding to three of the four driving shafts of the four oil hydraulic cylinders, or by detecting any three positions of the cushion pad other than these driving shafts; therefore, it may be configured to detect any three die cushion positions, and calculate an equation of a plane based on these three positions, thereby calculating each instructing position of the four driving shafts, or calculating the positions with the offset values based on (in accordance with) the equation of a plane.

In the present embodiment, the die cushion force is generated in the cushion pad of the die cushion apparatus, and the oil hydraulic cylinders are used as cushion pad raising and lowering devices for raising and lowering the cushion pad, but the present invention is not limited to the oil hydraulic cylinders, and other cushion pad raising and lowering devices may be used, instead. For example, it may be configured that multiple ball screw mechanisms are disposed in the cushion pad, and multiple electric servo motors are used for driving the respective ball screw mechanisms so as to carry out the die cushion force control and the die cushion position control.

The die cushion apparatus according to the present invention is not limited to a crank press, but may be applicable to any types of press machines including a mechanical press.

In addition, the present invention is not limited to the aforementioned examples, and it is needless to mention that various modifications and alternations can be appropriately made without departing from the spirit and scope of the present invention.

What is claimed is:

1. A die cushion apparatus of a press machine, the press machine including an upper die mounted to a slide, a lower die mounted to a bed, and a blank holding plate disposed between the upper die and the lower die and mounted to a cushion pad, the die cushion apparatus comprising:

multiple cushion pad raising and lowering devices configured to raise and lower the cushion pad by separately-controllable multiple driving shafts;

a die cushion position instructing unit configured to output position instruction values for instructing positions of the multiple cushion pad raising and lowering devices in a raising and lowering direction, the position instruction values including standby position instruction values for at least holding the cushion pad at a standby position, and outputting the standby position instruction values after knocking out a product from the press machine;

multiple die cushion position detecting devices configured to detect the position of the cushion pad corresponding to the position for each driving shaft of the multiple cushion pad raising and lowering devices, and output position detection values indicating the detected positions;

an information acquiring device configured to acquire information regarding inclination of the cushion pad based on the position detection values outputted from the multiple die cushion position detecting devices in a duration of a die cushion force control of the press machine;

an offset adjusting device configured to offset the position instruction values including the standby position instruction values outputted from the die cushion position instructing unit based on the multiple position detection values outputted from the multiple die cushion position detecting devices to affect the acquired inclination of the cushion pad at the standby position; and a controlling device configured to separately control the multiple cushion pad raising and lowering devices based on the position instruction values outputted from the die cushion position instructing unit, and on the multiple position detection values outputted from the multiple die cushion position detecting devices, the controlling device configured to move the cushion pad to the standby position based on the offset standby position instruction values outputted from the die cushion position instructing unit after knocking out the product, wherein the offset adjusting device offsets the standby position values based on the information regarding inclination of the cushion pad acquired from the information acquiring device to allow the cushion pad to be inclined in the standby position to be parallel with lower faces of the upper die mounted to the slide of the press machine.

2. The die cushion apparatus of a press machine according to claim 1, further comprising a correcting device configured to, based on the information regarding inclination of the cushion pad acquired from the information acquiring device, automatically correct the offset standby position instruction values set in the offset adjusting device so as to hold the inclination of the cushion pad at the standby position of the cushion pad.

3. The die cushion apparatus of a press machine according to claim 1, wherein the information acquiring device acquires the multiple position detected values outputted from the multiple die cushion position detecting devices as the information regarding the inclination of the cushion pad, wherein the multiple position detected values are associated with each time in the duration of the die cushion force control, a position of the slide, or die cushion force applied onto the multiple driving shafts.

4. The die cushion apparatus of a press machine according to claim 1, wherein the multiple cushion pad raising and lowering devices function as cushion force generating devices that generate a die cushion force via the multiple driving shafts at a time of lowering the slide of the press machine.

* * * * *